US005709582A

United States Patent [19]

O'Donnell

[11] Patent Number: 5,709,582

[45] Date of Patent: Jan. 20, 1998

[54] INFANT STIMULUS TOY APPARATUS

[76] Inventor: Teresa Hohol O'Donnell, 12 Morningside Dr., Billerica, Mass. 01821-1448

[21] Appl. No.: 666,656

[22] Filed: Jun. 17, 1996

[51] Int. Cl.[6] ..... A63H 33/00

[52] U.S. Cl. ..... 446/227

[58] Field of Search ..... 446/227; 434/247, 434/258, 259, 429, 430

[56] References Cited

U.S. PATENT DOCUMENTS

| | | | |
|---|---|---|---|
| D. 187,218 | 2/1960 | McHugh | 434/258 X |
| D. 244,959 | 7/1977 | Moustakas et al. | D21/1 |
| D. 286,656 | 11/1986 | Kamentsky | D21/59 |
| D. 297,550 | 9/1988 | Chuk-Sun | D21/63 |
| 3,191,319 | 6/1965 | Waisgerber | 434/299 |
| 3,414,987 | 12/1968 | Lindenhauer | 434/429 |
| 4,722,713 | 2/1988 | Williams et al. | 446/227 |
| 4,746,296 | 5/1988 | Culgan | 446/227 X |
| 4,968,279 | 11/1990 | Smith | 446/227 X |
| 4,973,286 | 11/1990 | Davison | 446/227 X |

*Primary Examiner*—William H. Grieb

[57] ABSTRACT

A toy apparatus includes a back housing portion, a structure connector assembly connected to the back housing portion, a plurality of item retainers connected to the back housing portion, a plurality of items retained in the item retainers, and a front housing portion which includes a hinge for connecting the front housing portion to the back housing portion. The front housing portion includes a plurality of windows which are placed in registration with the items when the front housing portion and the back housing portion are in a closed orientation. A housing lock assembly is connected between the back housing portion and the front housing portion for keeping the back housing portion and the front housing portion in a closed orientation. Each of the item retainers includes a set of three right-angle brackets which are located on the back housing portion such that the right-angle brackets are located outside of the windows of the front housing portion when the front housing portion is closed with respect to the back housing portion. Each of the item retainers further includes a plurality of slots located on the back housing portion and a plurality of complementary tabs located on the front housing portion. Each tab fits its complementary slot when the apparatus is closed. Spring-loaded child-proof housing lock assemblies are connected between the front housing portion and the back housing portion.

17 Claims, 3 Drawing Sheets

INFANT STIMULUS TOY APPARATUS

BACKGROUND OF THE INVENTION

1. Field of the Invention

The present invention relates generally to toys for children, and, more particularly, to toys especially adapted for stimulating infants and young toddlers.

2. Description of the Prior Art

When children are infants and toddlers, they often spend quite a bit of time in static environments such as cribs, playpens, or car seats. To keep such children from becoming restless and bored, toys are often provided to entertain and stimulate the child. Toys used in the above-mentioned static environments are often supported by a static structure in the environment. One problem associated with such toys is that each toy has its own associated supporting device for supporting the toy on the static structure. This situation requires removal and placement of associated supporting device each time a toy is removed or placed. Such removal and replacement of supporting devices for toys may require considerable time and effort, especially when such toys are replaced often. In this respect, it would be desirable if a child stimulating toy were provided which does not require removal and replacement of a supporting device each time a child-stimulating toy is replaced.

Moreover, since each child-stimulating toy has its own dedicated supporting device for supporting the toy on a static structure, The cost of each toy must include the cost of a supporting device. To avoid such multiplication of supporting devices and the costs thereof, it would be desirable if a child stimulating toy were provided with a single supporting device that can be used to support a variety of interchangeable child-stimulating toys.

Often a child uses a toy which provides a certain level of simulation and interest for a period of time and is then ready for a more advanced toy. In this respect, it would be desirable if a child stimulating toy were provided with means for easily upgrading the toy to a more advanced level.

Throughout the years, a number of innovations have been developed relating to child stimulating toys for static structures, and the following U.S. patents are representative of some of those innovations: U.S. Pat. Nos. 4,722,713, 4,968,279, 4,973,286, Des. 244,959, Des. 286,656, and Des. 297,550. More specifically, U.S. Pat. No. 4,722,713 discloses a crib-attached toy that includes a plurality of handing and pendulously swinging toys. When a toy swings in a pendulum fashion, it may be difficult for a child to accurately focus one's eyes on such a moving toy. In this respect, it would be desirable if a child stimulating toy were provided which does not swing in pendulum fashion from an overhead support. U.S. Pat. No. 4,973,286 discloses a crib-attached toy that includes three permanently attached cartoon figures. Electronic circuitry provides music and other sounds to accompany motion of the cartoon figures. The following patents may also be of interest for their disclosure of additional child-stimulating toys attached to cribs: U.S. Pat. No. 4,968,279, Des. 244,959, Des. 286,656, and Des. 297,550.

Still other features would be desirable in an infant stimulus toy apparatus that is supported by a static structure. For example, when a toy is supported by a static structure, it would be desirable if the orientation of the toy were controlled so that the toy does not improperly shift in its support structure. In addition, a child may attempt to open or disassemble a stimulating toy attached to a static structure.

In this respect, it would be desirable if a child stimulating toy were provided which is locked in such a way that prevents a child from opening the toy.

Thus, while the foregoing body of prior art indicates it to be well known to use child-stimulating toys attached to static structures, the prior art described above does not teach or suggest an infant stimulus toy apparatus which has the following combination of desirable features: (1) does not require removal and replacement of a supporting device each time a child-stimulating toy is replaced; (2) provides a single supporting device that can be used to support a variety of interchangeable child-stimulating toys; (3) can be easily upgraded to a more advanced level; (4) does not swing in pendulum fashion from an overhead support; (5) does not improperly shift its orientation in its support structure when the toy is used; and (6) provides locks which are locked in such a way that prevents a child from opening the toy. The foregoing desired characteristics are provided by the unique infant stimulus toy apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a toy apparatus which includes a back housing portion, a structure connector assembly connected to the back housing portion, a plurality of item retainers connected to the back housing portion, a plurality of items retained in the item retainers, and a front housing portion which includes a housing connector for connecting the front housing portion to the back housing portion. The front housing portion includes a plurality of windows which are placed in registration with the items when the front housing portion and the back housing portion are in a closed orientation. A housing lock assembly is connected between the back housing portion and the front housing portion for keeping the back housing portion and the front housing portion closed with respect to each other. The housing connector includes a hinge connected between an edge of the back housing portion and a complementary edge of the front housing portion.

The structure connector assembly includes a vertical back strap connected to the back housing portion. A back-strap lock element is connected to the vertical back swap. A vertical front strap is connected to the front housing portion, and a front-strap lock element is connected to the vertical front strap. The back-strap lock element and the front-strap lock element are complimentary and interconnect with each other. The back-strap lock element includes a quantity of hook or loop material, and the front-strap lock element includes a quantity of complementary loop or hook material.

The structure connector assembly further includes a horizontal structure-connector strap assembly connected to the front housing portion. Each of the item retainers includes a set of three right-angle brackets. The right-angle brackets are located on the back housing portion such that the right-angle brackets are located outside of the windows of the front housing portion when the front housing portion is closed with respect to the back housing portion. Each of the item retainers further includes a plurality of slots located on the back housing portion. A plurality of tabs are located on the front housing portion. Each tab fits into a corresponding slot when the front housing portion is closed with respect to the back housing portion. The slots are located on the back housing portion and the tabs are located on the front housing portion such that the slots and the tabs are located outside of the windows of the from housing portion when the front housing portion is closed with respect to the back housing portion.

The front housing portion has a four-cornered perimeter. The back housing portion has a four-cornered perimeter, and the back housing portion is nested with the front housing portion when the back housing portion and the front housing portion are in a closed orientation.

A housing lock assembly is connected between the front housing portion and the back housing portion. The housing lock assembly includes a housing lock strap connected to the front housing portion, and a lock post is connected to the back housing portion.

The housing lock assembly includes a child-proof lock assembly. The child-proof lock assembly includes a first pair of push-button lock assemblies located adjacent to a first pair of nested corners of the front housing portion and the back housing portion.

The first pair of push-button lock assemblies are located apart from one another by a distance which is sufficiently large to preclude a child's hand from operating both of the first pair of push-button lock assemblies simultaneously. Each of the first pair of push-button lock assemblies includes a spring-loaded push button assembly supported by the back housing portion. A button-receiving aperture is located in the front housing portion. The button-receiving aperture is in registration with the spring-loaded push button assembly when the front housing portion and the back housing portion are in a closed orientation.

The spring-loaded push button assembly includes a well in the back housing portion. A spring received in the well, and a button supported by the spring. A second pair of push-button lock assemblies is located adjacent to a second pair of nested corners of the front housing portion and the back housing portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved infant stimulus toy apparatus which has all of the advantages of the prior art and none of the disadvantages.

It is another object of the present invention to provide a new and improved infant stimulus toy apparatus which may be easily and efficiently manufactured and marketed.

It is a further object of the present invention to provide a new and improved infant stimulus toy apparatus which is of durable and reliable construction.

An even further object of the present invention is to provide a new and improved infant stimulus toy apparatus which is susceptible of a low cost of manufacture with regard to both materials and labor, and which accordingly is then susceptible of low prices of sale to the consuming public, thereby making such infant stimulus toy apparatus available to the buying public.

Still yet a further object of the present invention is to provide a new and improved infant stimulus toy apparatus which does not require removal and replacement of a supporting device each time a child-stimulating toy is replaced.

Still another object of the present invention is to provide a new and improved infant stimulus toy apparatus that provides a single supporting device that can be used to support a variety of interchangeable child-stimulating toys.

Yet another object of the present invention is to provide a new and improved infant stimulus toy apparatus which can be easily upgraded to a more advanced level.

Even another object of the present invention is to provide a new and unproved infant stimulus toy apparatus that does not swing in pendulum fashion from an overhead support.

Still a further object of the present invention is to provide a new and improved infant stimulus toy apparatus which does not improperly shift its orientation in its support structure when the toy is used.

Yet another object of the present invention is to provide a new and improved infant stimulus toy apparatus that provides locks which are locked in such a way that prevents a child from opening the toy.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
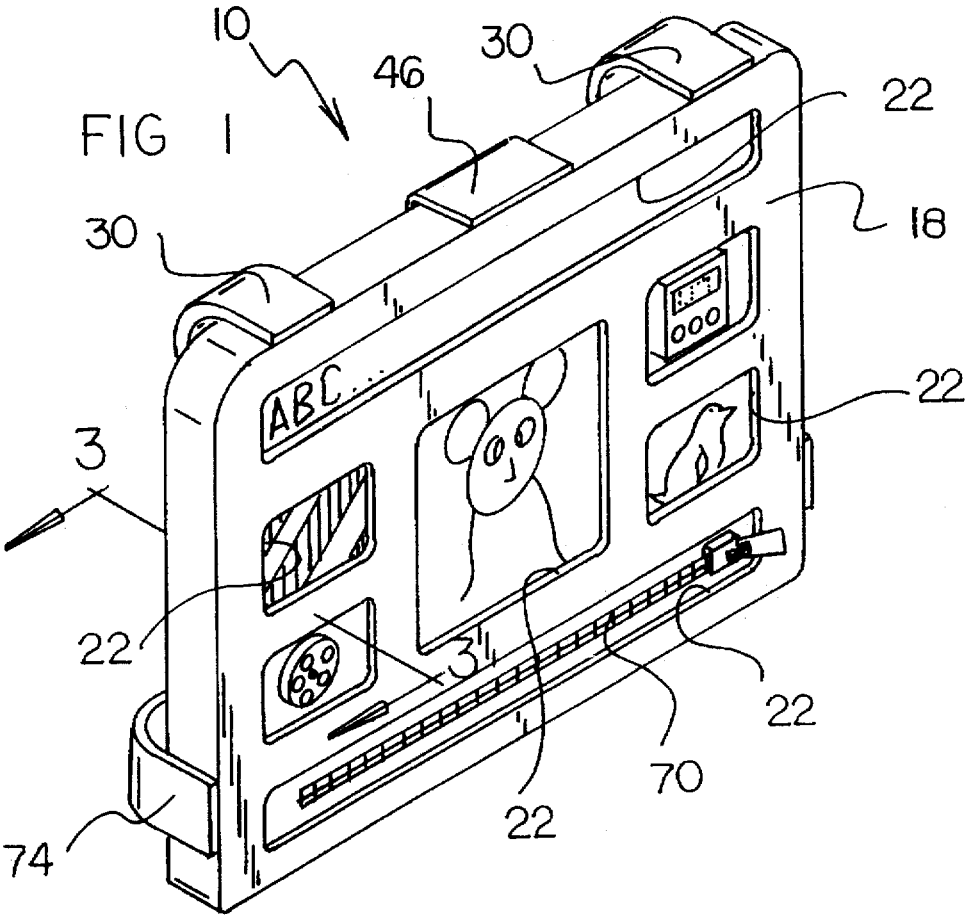
FIG. 1 is a front perspective view showing a first embodiment of the infant stimulus toy apparatus of the invention shown in a closed orientation.
Figure 2:
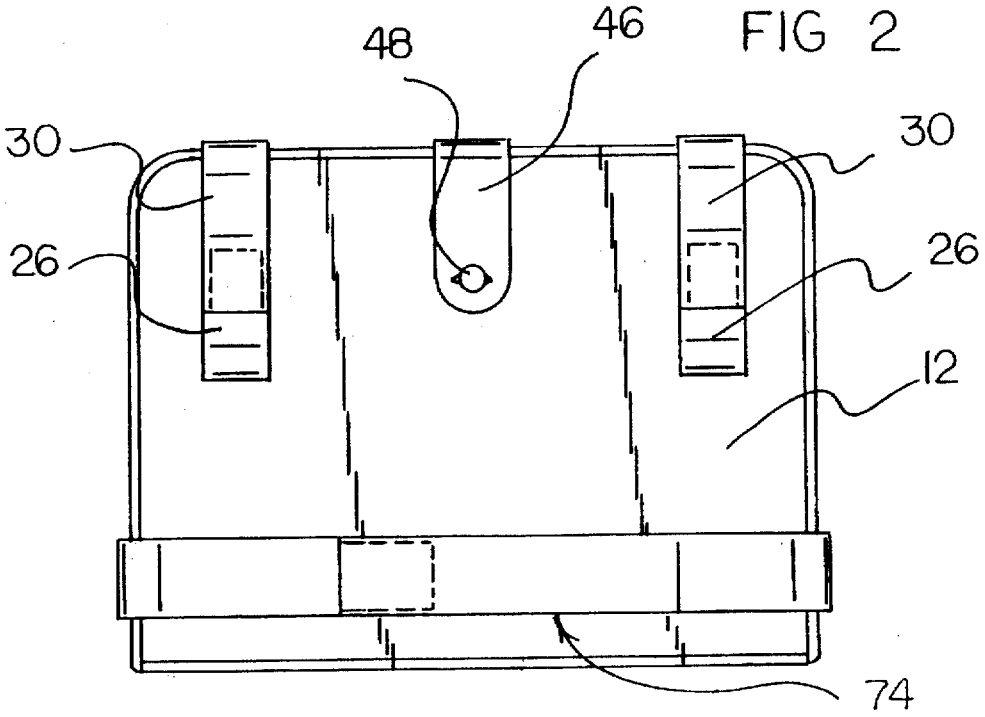
FIG. 2 is a rear view of the embodiment of the infant stimulus toy apparatus shown in FIG. 1.
Figure 3:
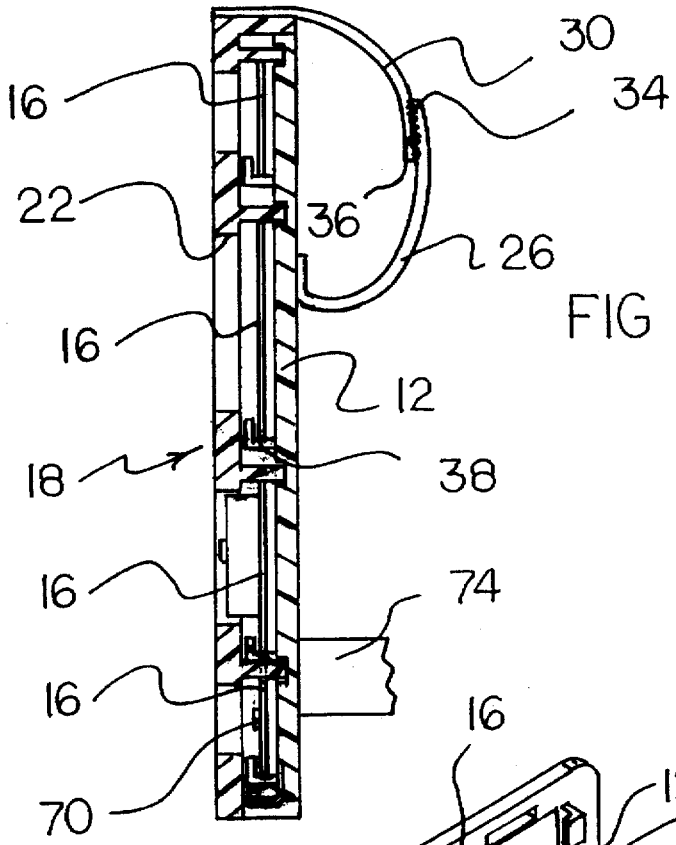
FIG. 3 is an enlarged cross-sectional view of the embodiment of the invention shown in FIG. 1 taken along line 3—3 thereof.

With reference to the drawings, a new and improved infant stimulus toy apparatus embodying the principles and concepts of the present invention will be described.

Turning to FIGS. 1–4, a first embodiment of the infant stimulus toy apparatus 10 of the invention includes a back housing portion 12, a structure connector assembly connected to the back housing portion 12, a plurality of item retainers connected to the back housing portion 12, a plurality of items 16 retained in the item retainers, and a front housing portion 18 which includes a housing connector for connecting the front housing portion 18 to the back housing portion 12. The front housing portion 18 includes a plurality of windows 22 which are placed in registration with the items 16 when the front housing portion 18 and the back housing portion 12 are in a closed orientation. A housing lock assembly is connected between the back housing portion 12 and the front housing portion 18 for keeping the back housing portion 12 and the front housing portion 18 closed with respect to each other. The housing connector includes a hinge 21 connected between an edge of the back housing portion 12 and a complementary edge of the front housing portion 18.

The structure connector assembly includes a vertical back strap 26 connected to the back housing portion 12. A back-strap lock element is connected to the vertical back strap 26. A vertical front strap 30 is connected to the front housing portion 18, and a front-strap lock element is connected to the vertical front strap 30. The back-strap lock element and the front-strap lock element are complimentary and interconnect with each other. The back-strap lock element includes a quantity of hook or loop material 34, and the front-strap lock element includes a quantity of complementary loop or hook material 36.

The structure connector assembly further includes a horizontal structure-connector strap assembly 74 connected to the front housing portion 18. Each of the item retainers includes a set of three right-angle brackets 38. The right-angle brackets 38 are located on the back housing portion 12 such that the right-angle brackets 38 are located outside of the windows 22 of the front housing portion 18 when the front housing portion 18 is closed with respect to the back housing portion 12. Each of the item retainers further includes a plurality of slots 40 located on the back housing portion 12. A plurality of tabs 42 are located on the front housing portion 18. Each tab 42 fits into a corresponding slot 40 when the front housing portion 18 is closed with respect to the back housing portion 12. The slots 40 are located on the back housing portion 12 and the tabs 42 are located on the front housing portion 18 such that the slots 40 and the tabs 42 are located outside of the windows 22 of the front housing portion 18 when the front housing portion 18 is closed with respect to the back housing portion 12.

The front housing portion 18 has a four-cornered perimeter. The back housing portion 12 has a four-cornered perimeter, and the back housing portion 12 is nested with the front housing portion 18 when the back housing portion 12 and the front housing portion 18 are in a closed orientation.

A housing lock assembly is connected between the from housing portion 18 and the back housing portion 12. The housing lock assembly includes a housing lock strap 46 connected to the front housing portion 18, and a lock post 48 is connected to the back housing portion 12.

In using the first embodiment of the invention, the vertical front straps 30 are disengaged from the vertical back straps 26, and the respective straps are threaded through a portion of a static structure, such as slats of a crib. Then, the hook or loop material 34 and the complementary loop or hook material 36 are connected together to secure the toy apparatus 10 onto the static structure. The horizontal structure-connector strap assembly 74 is connected to the static structure in the same way as the vertical back straps 26 and the vertical front straps 30.

Figure 4:
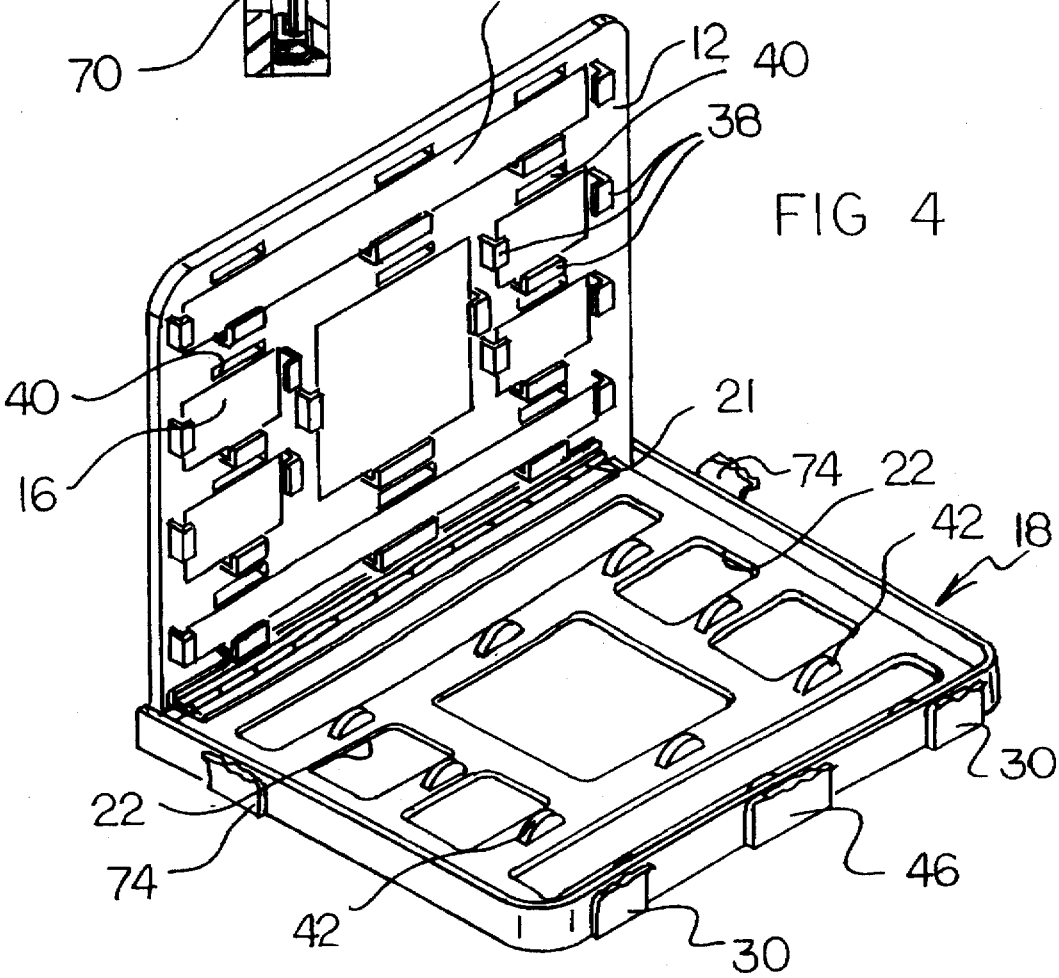
FIG. 4 is a perspective view of the embodiment of the invention shown in FIG. 1 in an open orientation.

To change the items 16 displayed through the windows 22, the housing lock strap 46 is removed from the lock post 48, and the back housing portion 12 is pulled away from the front housing portion 18 around hinge 21, as shown in FIG. 4. The items 16 are lifted off of the right-angle brackets 38 to remove the items 16 from the back housing portion 12, and the items 16 are lowered onto the right-angle brackets 38 to put the items 16 in place in the back housing portion 12. As shown in FIG. 1, the items includes cards which have designs appealing to a child's eyes. Also, the items 16 can includes cards which carry sound or noise generators. Also, the items 16 can includes cards which stimulate tactile responses in the child, such as a zipper 70. Cards are easily interchanged with one another while the toy apparatus 10 is attached to a structure without removing the toy apparatus 10 from the structure. A first set of items 16 can be easily upgraded to a second set of items 16 with the toy apparatus 10 of the invention.

Once some desired items 16 are removed and some desired items 16 are replaced, the back housing portion 12 is swung into registration with the front housing portion 18. As a result, the items 16 supported by the back housing portion 12 are visual through the windows 22 in the front housing portion 18, as shown in FIG. 1. When the back housing portion 12 is closed with respect to the front housing portion 18, the tabs 42 of the front housing portion 18 fit into the slots 40 of the back housing portion 12. As a result, the items 16 are prevented from sliding out of their display positions in the back housing portion 12. This is true no matter how the toy apparatus 10 is oriented. Once the back housing portion 12 and the front housing portion 18 are in a closed orientation, the housing lock strap 46 is reconnected to the lock post 48.

Figure 5:
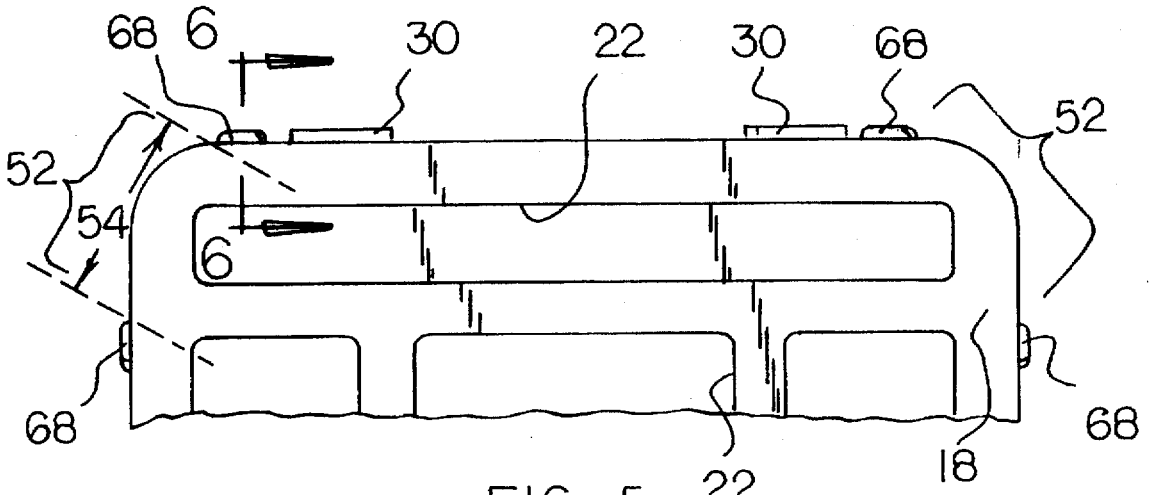
FIG. 5 is a partial front view of a second embodiment of the invention which includes locks for keeping the apparatus in a closed orientation.
Figure 6:
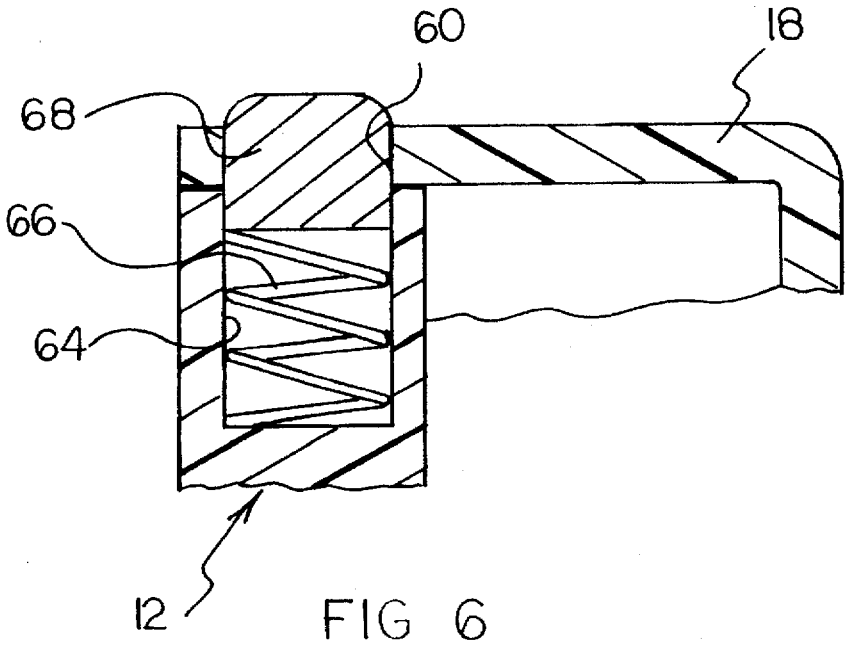
FIG. 6 is an enlarged, partial cross-sectional view of the embodiment of the invention shown in FIG. 5 taken along line 6—6 thereof.

Turning to FIGS. 5 and 6, a second embodiment of the invention is shown. Reference numerals are shown that correspond to like reference numerals that designate like elements shown in the other figures. The overall operation of the second embodiment of the invention is substantially the same as the first embodiment of the invention. In addition, a housing lock assembly includes a child-proof lock assembly. The child-proof lock assembly includes a first pair of push-button lock assemblies 52 located adjacent to a first pair of nested corners of the front housing portion 18 and the back housing portion 12.

The first pair of push-button lock assemblies 52 are located apart from one another by a distance 54 which is sufficiently large to preclude a child's hand from operating both of the first pair of push-button lock assemblies 52 simultaneously. Each of the first pair of push-button lock assemblies 52 includes a spring-loaded push button assembly supported by the back housing portion 12. A button-receiving aperture 60 is located in the front housing portion 18. The button-receiving aperture 60 is in registration with the spring-loaded push button assembly when the front housing portion 18 and the back housing portion 12 are in a closed orientation.

The spring-loaded push button assembly includes a well 64 in the back housing portion 12. A spring 66 received in the well 64, and a button 68 supported by the spring 66. A second pair of push-button lock assemblies 52 is located adjacent to a second pair of nested corners of the front housing portion 18 and the back housing portion 12.

In using the pair of push-button lock assemblies 52 of the second embodiment of the invention, when the back housing portion 12 and the front housing portion 18 are in closed orientation, the buttons 68 are pressed down to overcome the bias of the springs 66 and to permit the buttons 68 to clear the button-receiving apertures 60 in the front housing portion 18. When this is done, the front housing portion 18 can be swung around the hinge 21 to lift the front housing portion 18 off of the back housing portion 12. The distance 54 between pairs of push-button lock assemblies 52 is sufficiently large to prevent a child from pressing all of the buttons 68 simultaneously. As a result, the push-button lock assemblies 52 provide child-proof locks for keeping the back housing portion 12 closed with respect to the front housing portion 18. More specifically, two adult hands are needed to operate the two pairs of the push-button lock assemblies 52.

The components of the infant stimulus toy apparatus of the invention can be made from inexpensive and durable metal, plastic, and paper materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved infant stimulus toy apparatus that is low in cost, relatively simple in design and operation, and which may advantageously be used without requiring removal and replacement of a supporting device each time a child-stimulating toy is replaced. With the invention, an infant stimulus toy apparatus provides a single supporting device that can be used to support a variety of interchangeable child-stimulating toys. With the invention, an infant stimulus toy apparatus is provided which can be easily upgraded to a more advanced level. With the invention, an infant stimulus toy apparatus is provided which does not swing in pendulum fashion from an overhead support. With the invention, an infant stimulus toy apparatus is provided which does not improperly shift its orientation in its support structure when the toy is used. With the invention, an infant stimulus toy apparatus provides locks which are locked in such a way that prevents a child from opening the toy.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A toy apparatus, comprising:

a back housing portion, a structure connector assembly connected to said back housing portion, a plurality of item retainers connected to said back housing portion, a plurality of items retained in said item retainers, and a front housing portion which includes a housing connector for connecting said front housing portion to said back housing portion, wherein said front housing portion includes a plurality of windows which are placed in registration with said items when said front housing portion and said back housing portion are closed with respect to each other, and a housing lock assembly, connected between said back housing portion and said front housing portion, for keeping said back housing portion and said front housing portion closed with respect to each other.

2. The apparatus of claim 1 wherein said housing connector includes a hinge connected between an edge of said back housing portion and a complementary edge of said front housing portion.

3. The apparatus of claim 1 wherein said structure connector assembly includes:

a vertical back strap connected to said back housing portion, a back-strap lock element connected to said vertical back strap, a vertical front strap connected to said front housing portion, and a front-strap lock element connected to said vertical front strap, wherein said back-strap lock element and said front-strap lock element are complimentary and interconnect with each other.

4. The apparatus of claim 3 wherein:

said back-strap lock element includes a quantity of hook or loop material, and said front-strap lock element includes a quantity of complementary loop or hook material.

5. The apparatus of claim 3 wherein said structure connector assembly further includes a horizontal structure-connector strap assembly connected to said front housing portion.

6. The apparatus of claim 1 wherein each of said item retainers includes a set of three right-angle brackets, wherein said right-angle brackets are located on said back housing portion such that said right-angle brackets are located outside of said windows of said front housing portion when said front housing portion is closed with respect to said back housing portion.

7. The apparatus of claim 6 wherein each of said item retainers further includes:

a slot located on said back housing portion, and a tab located on said front housing portion, wherein said tab fits into said slot when said front housing portion is closed with respect to said back housing portion.

8. The apparatus of claim 7 wherein said slots are located on said back housing portion and said tabs are located on said front housing portion such that said slots and said tabs are located outside of said windows of said front housing portion when said front housing portion is closed with respect to said back housing portion.

9. The apparatus of claim 1 wherein:

said from housing portion has a four-cornered perimeter, said back housing portion has a four-cornered perimeter, and said back housing portion is nested with said front housing portion when said back housing portion and said front housing portion are in a closed orientation.

10. The apparatus of claim 1, further including:

a housing lock assembly connected between said front housing portion and said back housing portion.

11. The apparatus of claim 10 wherein said housing lock assembly includes:

a housing lock strap connected to said front housing portion, and a lock post connected to said back housing portion.

12. The apparatus of claim 10 wherein said housing lock assembly includes a child-proof lock assembly.

13. The apparatus of claim 12 wherein said child-proof lock assembly includes:

a first pair of push-button lock assemblies located adjacent to a first pair of nested corners of said from housing portion and said back housing portion.

14. The apparatus of claim 13 wherein said first pair of push-button lock assemblies are located apart from one another by a distance which is sufficiently large to preclude a child's hand from operating both of said first pair of push-button lock assemblies simultaneously.

15. The apparatus of claim 13 wherein each of said first pair of push-button lock assemblies includes:

a spring-loaded push button assembly supported by said back housing portion, and a button-receiving aperture located in said from housing portion, wherein said button-receiving aperture is in registration with said spring-loaded push button assembly when said front housing portion and said back housing portion are in a closed orientation.

16. The apparatus of claim 15 wherein said spring-loaded push button assembly includes:

a well in said back housing portion, a spring received in said well, and a button supported by said spring.

17. The apparatus of claim 13, further including:

a second pair of push-button lock assemblies located adjacent to a pair of nested corners of said front housing portion and said back housing portion.

* * * * *